US005754387A

United States Patent [19]

Tennies et al.

[11] Patent Number: 5,754,387

[45] Date of Patent: May 19, 1998

[54] METHOD OF MONITORING CONTACTOR OPERATION

[75] Inventors: Charles J. Tennies, Waukesha; Richard J. Fons, Milwaukee, both of Wis.

[73] Assignee: Eaton Corporation, Cleveland, Ohio

[21] Appl. No.: 663,475

[22] Filed: Jun. 13, 1996

[51] Int. Cl.[6] ..... H01H 47/00

[52] U.S. Cl. ..... 361/170; 361/195

[58] Field of Search ..... 361/170, 154, 361/160, 187, 195, 194

[56] References Cited

U.S. PATENT DOCUMENTS

| | | | |
|---|---|---|---|
| 3,401,362 | 9/1968 | Spiroch et al. | 335/17 |
| 4,760,364 | 7/1988 | Ostby | 335/132 |
| 4,771,253 | 9/1988 | Sasaki et al. | 335/17 |
| 4,905,121 | 2/1990 | Uetsuhara et al. | 361/159 |
| 4,953,056 | 8/1990 | Yakuwa et al. | 361/154 |
| 4,967,309 | 10/1990 | Hoffmann | 361/160 |
| 5,128,825 | 7/1992 | Hurley et al. | 361/154 |
| 5,196,983 | 3/1993 | Stumpf | 361/154 |
| 5,204,633 | 4/1993 | Ahladas et al. | 324/654 |
| 5,241,218 | 8/1993 | Page | 307/104 |
| 5,278,530 | 1/1994 | Zovath | 335/17 |
| 5,293,551 | 3/1994 | Perkins et al. | 361/154 |
| 5,424,900 | 6/1995 | Kiiskinen et al. | 361/116 |
| 5,490,031 | 2/1996 | Braun et al. | 361/93 |
| 5,539,608 | 7/1996 | Hurley et al. | 361/152 |

*Primary Examiner*—Jeffrey A. Gaffin
*Assistant Examiner*—Sally C. Medley
*Attorney, Agent, or Firm*—Tarolli, Sundheim, Covell, Tummino & Szabo

[57] ABSTRACT

Upon initiation of operation of a contactor from an unactuated condition to an actuated condition, the maximum magnitude of an initial current conducted to the coil of the contactor is determined. Once the contactor has been operated to the closed condition, the holding current is checked to determine if it exceeds a reference current. The reference current is a predetermined function of the maximum initial current. If the reference current is less than the holding current, a malfunction signal is provided. In another embodiment of the invention, a sensor is provided to sense the position of movable contacts connected with an armature of the contactor.

43 Claims, 6 Drawing Sheets

METHOD OF MONITORING CONTACTOR OPERATION

BACKGROUND OF THE INVENTION

The present invention relates to a new and improved method of monitoring operation of a contactor.

It has previously been suggested that the position of a movable contact could be determined by the use of a position sensor. Thus, in U.S. Pat. No. 5,424,900, the position of a permanent magnet connected with movable contacts is detected. In U.S. Pat. No. 3,401,362, a switch is utilized to detect the position of soft iron core connected with an armature of a magnet.

It has also been suggested that the operating condition of a contactor could be determined by sensing changes in the current conducted to a coil of the contactor. Thus, U.S. Pat. No. 5,204,663 discloses the concept of sensing when a contactor is in a closed condition by sensing changes in the inductance of a coil of the contactor. In U.S. Pat. No. 5,241,218, the presence or absence of a momentary reduction in the value of the current for energizing a coil of a contactor is detected to determine whether or not the contactor has operated correctly.

SUMMARY OF THE INVENTION

The present invention provides a new and improved method for controlling the operation of a contactor. Upon initiation of operation of the contactor from an unactuated condition to an actuated condition, the maximum magnitude of an initial current conducted to the coil of the contactor is determined. After a period of time sufficient for the contactor to actuate, the magnitude of a holding current conducted to the coil is determined. A determination is made as to whether or not the holding current exceeds a predetermined function of the maximum magnitude of the initial current conducted to the coil of the contactor. If the holding current is less than the predetermined function of the initial current, the contactor has been properly actuated to the closed condition.

In another embodiment of the invention, a sensor assembly is provided to detect the position of the movable contacts of the contactor relative to stationary contacts. In both embodiments of the invention, a determination is made as to whether or not the contactor is properly operated from the unactuated condition to the actuated condition at the end of a predetermined time.

BRIEF DESCRIPTION OF THE DRAWINGS

The foregoing and other features of the invention will become more apparent upon a consideration of the following description taken in connection with the accompanying drawings, wherein.

DESCRIPTION OF SPECIFIC PREFERRED EMBODIMENTS OF THE INVENTION

General Description

Figure 1:
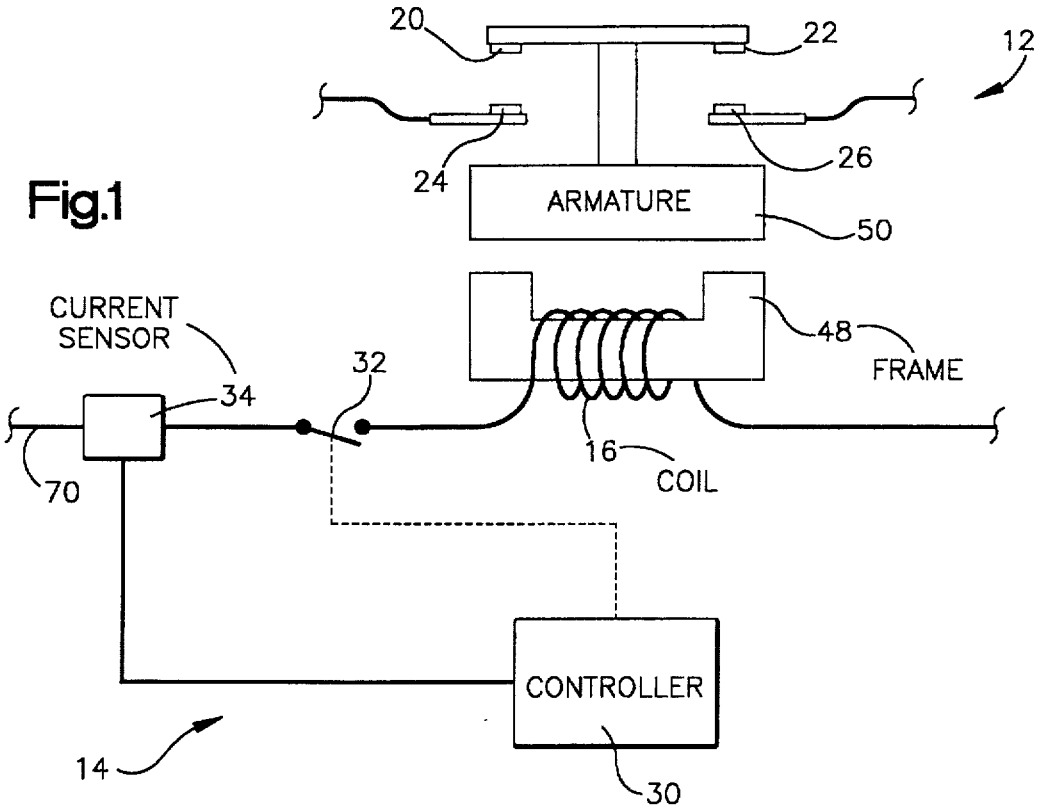
FIG. 1 is a schematic illustration of a contactor and a contactor control system which is operated in accordance with the present invention.

A contactor 12 is illustrated in FIG. 1 in association with control circuitry 14. The control circuitry 14 is utilized to determine whether or not the contactor 12 is correctly operated from an unactuated condition to an actuated condition. The control circuitry 14 monitors the current conducted to a coil 16 of the contactor 12.

When the contactor 12 is in the open or unactuated condition illustrated in FIG. 1, movable contacts 20 and 22 are spaced from stationary contacts 24 and 26. Upon initiation of operation of the contactor 12 from the unactuated condition to a closed or actuated condition, a controller or microprocessor 30 in the control circuitry 14 effects operation of a switch 32 from the illustrated open condition to a closed condition to effect energization of the coil 16. The switch 32 may be either a mechanical switch or a semiconductor. The current conducted to the coil 16 is measured by a current sensor 34 and its peak value varies in the manner depicted schematically by a curve 36 in FIG. 2. The curve 36 is a representation of the peaks of a sinusoidally varying current which is conducted to the coil 16.

When the contactor 12 is in the unactuated condition, there is no current conducted to the coil 16. This is illustrated schematically by a portion 38 of the curve 36 in FIG. 2. Upon initiation of operation of the contactor 12 from the unactuated condition to the actuated condition, an initial current is conducted to the coil 16. The initial current is indicated schematically by the portion 42 of the curve 36. The initial current conducted to the coil 16 quickly increases to a relatively large maximum magnitude, indicated at 44 in FIG. 2.

Initial energization of the coil 16 causes a magnetic field from a frame 48 (FIG. 1) of the contactor 12 to attract an armature 50 of the contactor. This causes the movable contacts 20 and 22 to move into engagement with the fixed contacts 24 and 26. Upon movement of the armature 50 close to or into engagement with the frame 48, the current conducted through the coil 16 quickly drops from the relatively large maximum initial current 44 (FIG. 2) to a relatively small holding or seal current 54.

Figure 2:
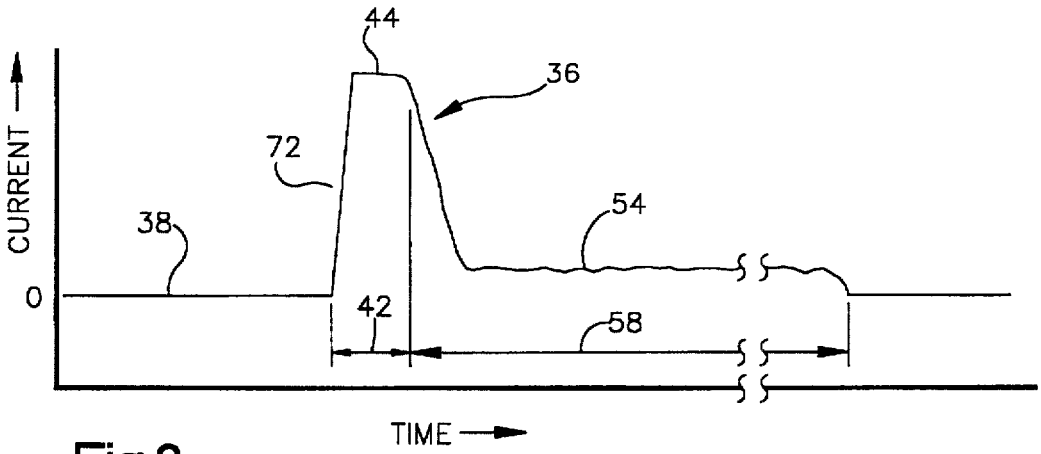
FIG. 2 is a schematic illustration depicting the manner in which peak current conducted to a coil of the contactor of FIG. 1 varies with time during operation of the contactor from an unactuated condition to an actuated condition.

The holding or seal current 54 is conducted to the coil 16 of the contactor 12 while the contactor is in the closed condition indicated by the portion 58 of the curve 36 (FIG. 2). The holding current 54 will have different values for different contactors. However, it is contemplated that the holding current 54 will usually be less than twenty percent of the maximum initial current 44.

The contactor 12 may have many different known constructions. However, in the embodiment of the invention illustrated in FIG. 1, the contactor 12 has a construction such as that disclosed in U.S. Pat. No. 4,760,364.

Algorithm

Figure 3:
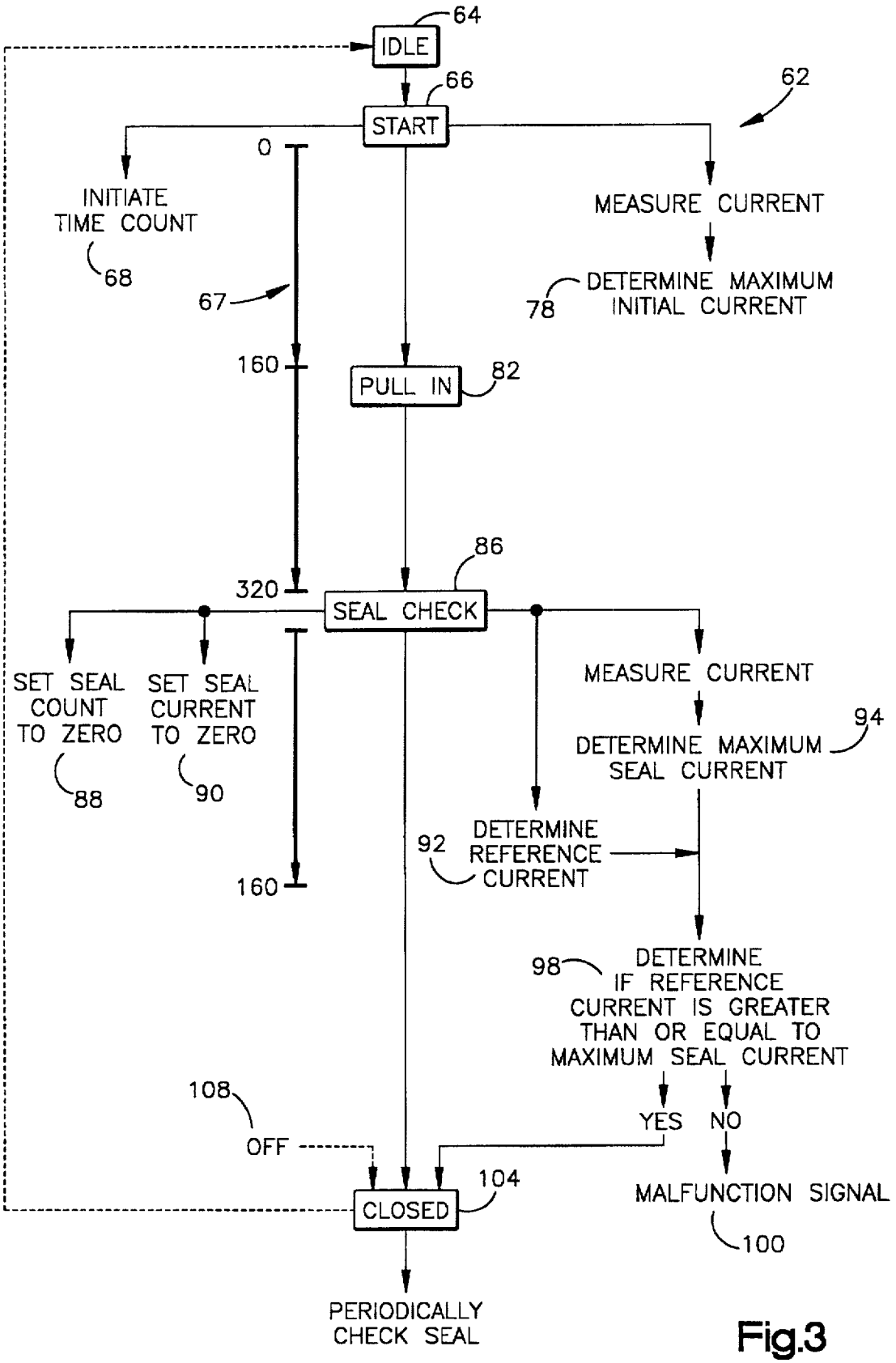
FIG. 3 is a simplified schematic illustration of an algorithm which is used in monitoring coil current to determine whether or not the contactor of FIG. 1 has properly operated from the unactuated condition to the actuated condition.
Figure 4:
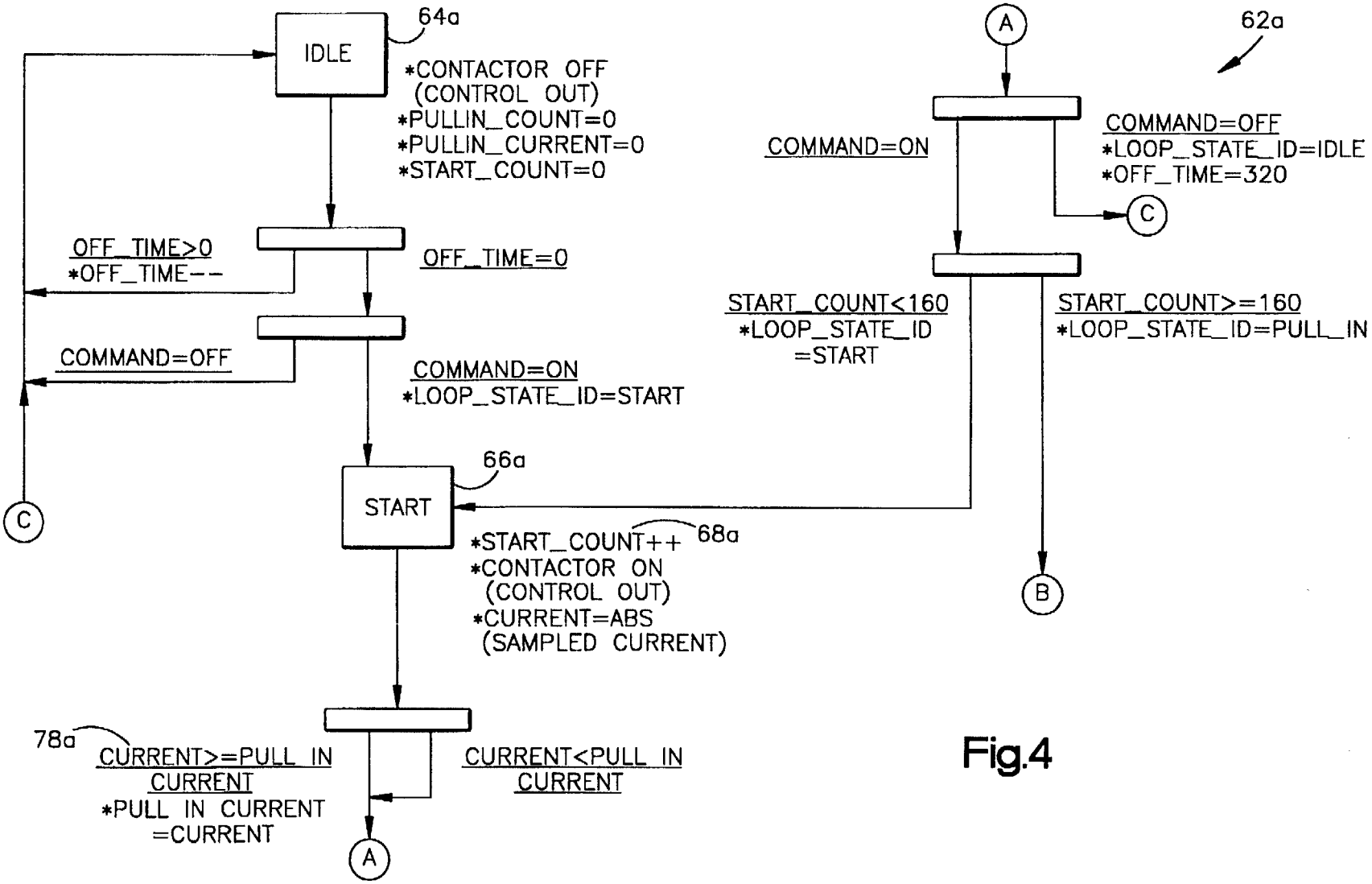
FIGS. 4, 5, 6 and 7 are more detailed schematic illustrations of the algorithm of FIG. 3.

An algorithm 62 for use in monitoring the operation of the contactor 12 is illustrated schematically in FIG. 3. When the contactor is in the unactuated condition, the algorithm 62 is in an initial or idle state indicated schematically at 64 in FIG. 3. After powering up of the controller 30, the algorithm 62 remains in the idle state until the controller 30 is commanded to initiate operation of the contactor 12 from the unactuated condition of FIG. 1 to the actuated condition.

After receiving the command to operate the contactor 12 from the unactuated condition to the actuated condition, the algorithm 62 (FIG. 3) changes from the idle state 64 to a start state 66. As soon as the algorithm 62 changes from the idle state 64 to the start state 66, the switch 32 (FIG. 1) is closed by the controller 30. Simultaneously therewith, a time count, indicated schematically at 67 in FIG. 3, is set to zero, as illustrated schematically by step 68 in the algorithm 62.

Upon closing of the switch 32 by the controller 30, current is conducted through a lead 70 (FIG. 1) to the coil 16. The initial current 42 (FIG. 2) increases in the manner illustrated by portion 72 of curve 36. The current conducted to the coil 16 is measured by the current sensor 34 (FIG. 1). The current sensor 34 is a known type of transducer which responds to the magnetic flux in the lead 70.

Data indicative of the magnitude of the current conducted to the coil 16 is transmitted to the controller 30. As the initial current conducted to the coil 16 increases, as illustrated by the portion 72 of the curve 36 in FIG. 2, the value of the initial current stored in the controller 30 is increased. When the maximum value of the initial current is reached, that is, the value corresponding to the portion 44 of the curve 36 in FIG. 2, this value remains stored in the controller 30, as indicated at step 78 in FIG. 3.

After a predetermined time count has elapsed, for example, a time count of 160 corresponding to 16 milliseconds, the state of the algorithm 62 changes from the start state to the pull-in state indicated schematically at 82 in FIG. 3. The algorithm remains in the pull-in state until a predetermined time period has elapsed, for example, until a time count of 320 or 32 milliseconds is reached.

After the predetermined time count of 320 has been reached, more than sufficient time will have elapsed for the contactor 12 to have operated from the unactuated condition to the actuated condition. Therefore, when the predetermined time count, for example a count of 320 corresponding to 32 milliseconds, has been reached, the algorithm 62 changes from the pull-in state indicated at 82 in FIG. 3 to the seal check state indicated at 86 in FIG. 3.

When changing from the pull-in state 82 to the seal check state 86, the seal count is set to zero. This step is indicated schematically at 88 in FIG. 3. At the same time, the value of the holding or seal current, stored in the controller 30 is also set to zero. This step is indicated schematically at 90 in FIG. 3.

Upon entering the seal check state 86, a reference current is determined. The reference current is a predetermined function of the maximum initial current 44. The maximum initial current 44 was determined at the step indicated schematically at 78 in the algorithm 62.

When the contactor 12 is in the actuated condition, the holding or seal current, indicated at 54 in FIG. 2, should be equal to or less than twenty percent of the maximum initial current 44. Therefore, the reference current is calculated to have a magnitude which is 0.20 of the maximum magnitude of the initial current 44. Of course, other fractions of the maximum initial current could be utilized for the reference current if desired.

Simultaneously with changing of the state of the algorithm 62 from the pull-in state 82 to the seal check state 86, a measurement of the magnitude of the holding or seal current conducted through the lead 70 to the coil 16 is transmitted from the sensor 34 to the controller 30. Measurement of the holding or seal current is repeatedly made to be certain that a maximum value of the current has been determined, in the manner indicated schematically at 94 in the algorithm 62.

The maximum seal or holding current conducted to the coil 16 is compared with the reference current. A determination is made as to whether or not the reference current is greater than or equal to the maximum seal current, at the step indicated schematically at 98 in FIG. 3. If the reference current is less than the maximum seal or holding current, a malfunction signal is provided, as indicated schematically by the step 100 in FIG. 3. Thus, a determination is made as to whether or not the operating current conducted to the coil 16 of the actuated contactor 12 exceeds the reference current.

If the contactor 12 has been correctly operated from the unactuated condition to the actuated condition, the reference current will be greater than or equal to the maximum seal or holding current. Thus, twenty percent of the maximum initial current will be greater than or equal to the maximum seal current when the contactor 12 has been properly operated to the actuated condition. If the reference current is greater than or equal to the maximum seal current, the state of the algorithm 62 changes from the seal check state 86 to the closed state indicated at 104 in FIG. 3.

The determination as to whether or not the reference current is greater than or equal to the maximum seal current, that is, the step indicated schematically at 98 in FIG. 3, is made when the time count from entering the seal check state 86 has reached 160, corresponding to 16 milliseconds. It should be understood that time counts which are different than the examples set forth herein could be used if desired.

Once the algorithm 62 has entered the closed state indicated at 104 in FIG. 3, the controller 30 periodically checks the seal current 54 and compares it with the reference current, that is, with twenty percent of the maximum initial current 44. If at any time while the algorithm 62 is in the closed state, indicated at 104 in FIG. 3, the seal or holding current 54 exceeds the reference current, a malfunction signal is provided.

When an off command, indicated at 108 in the algorithm 62 in FIG. 3, is provided, the state of the algorithm changes from the closed state back to the idle state. The algorithm remains in the idle state until a start command is received. In the embodiment of the algorithm 62 illustrated in FIG. 3, whenever a malfunction signal is provided, the algorithm reverts to the idle state. When the algorithm is in the idle state, the contactor 12 is forced to the unactuated condition.

Algorithm—Detailed Embodiment

FIG. 3 is a simplified schematic illustration of the algorithm 62 which is utilized to monitor the current conducted to the coil of the contactor 12. A more detailed schematic illustration of one embodiment of the algorithm 62 is illustrated in FIGS. 4 through 7. Since the algorithm of FIGS. 4 through 7 is generally similar to the algorithm of FIG. 3, similar numerals have been utilized to designate similar functions and/or states in the algorithm of FIGS. 4–7, the suffix letter "a" being associated with the numerals of FIGS. 4–7 to avoid confusion.

When the algorithm **62*a* (FIG. 4) is in the idle state 64*a*, the contactor 12 (FIG. 1) is in the unactuated condition. In the idle state 64*a* (FIG. 4**), variables are initialized to zero. A check is made to see if the idle state has been active for a minimum time, that is for a time count of 320 or 32 milliseconds.

Once the minimum time requirement has been reached, a check is made to see if the contactor 12 has been commanded to the actuated condition. If the contactor 12 is still commanded to the unactuated condition, the algorithm **62*a*** remains in the idle state 64a. If an ON command has been received, the algorithm 62a goes to the start state 66a.

Once in the start state 66a, the start count is incremented. At the same time, the controller 30 actuates the switch 32 (FIG. 1) to a closed condition to enable current to be conducted through the lead 70 to the coil 16. The current is then repeatedly sampled, as indicated at 68a in FIG. 4. If, after a first current sample has been made, the magnitude of the coil current exceeds the previous magnitude of the coil current, the maximum initial current is increased to the magnitude of the most recently sampled coil current. The purpose of this is to find the magnitude of the maximum initial current conducted to the coil 16.

Next, the command signal is checked. If the command signal has been changed to an OFF command, the algorithm 62a changes back to the idle state 64a. If an ON command is still present, the start count is checked to see if it has reached 160 counts or 16 milliseconds. If the start count has not reached 160, the algorithm 62a remains in the start state 66a.

Figures 5, 6:
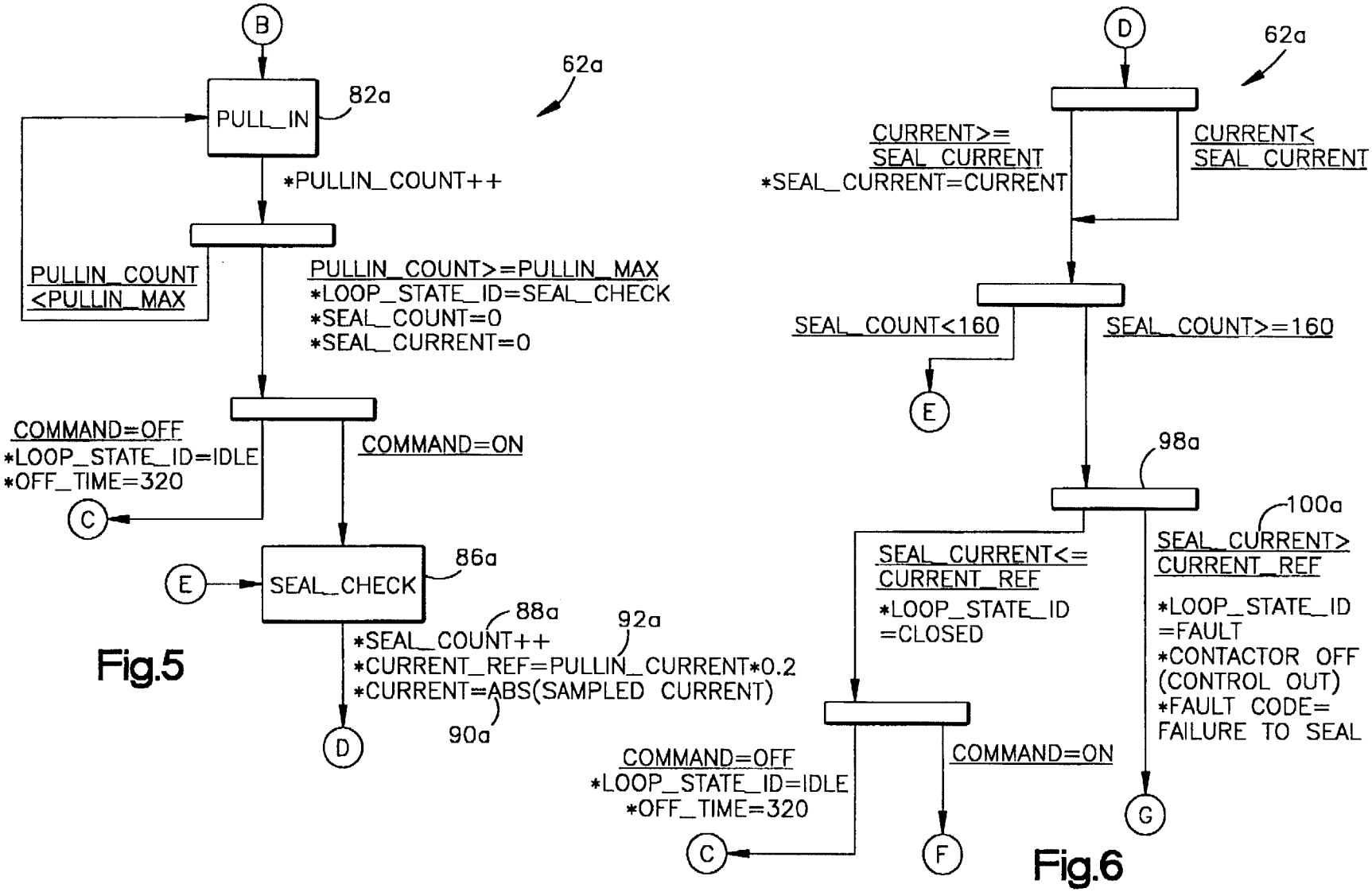
Figure 7:
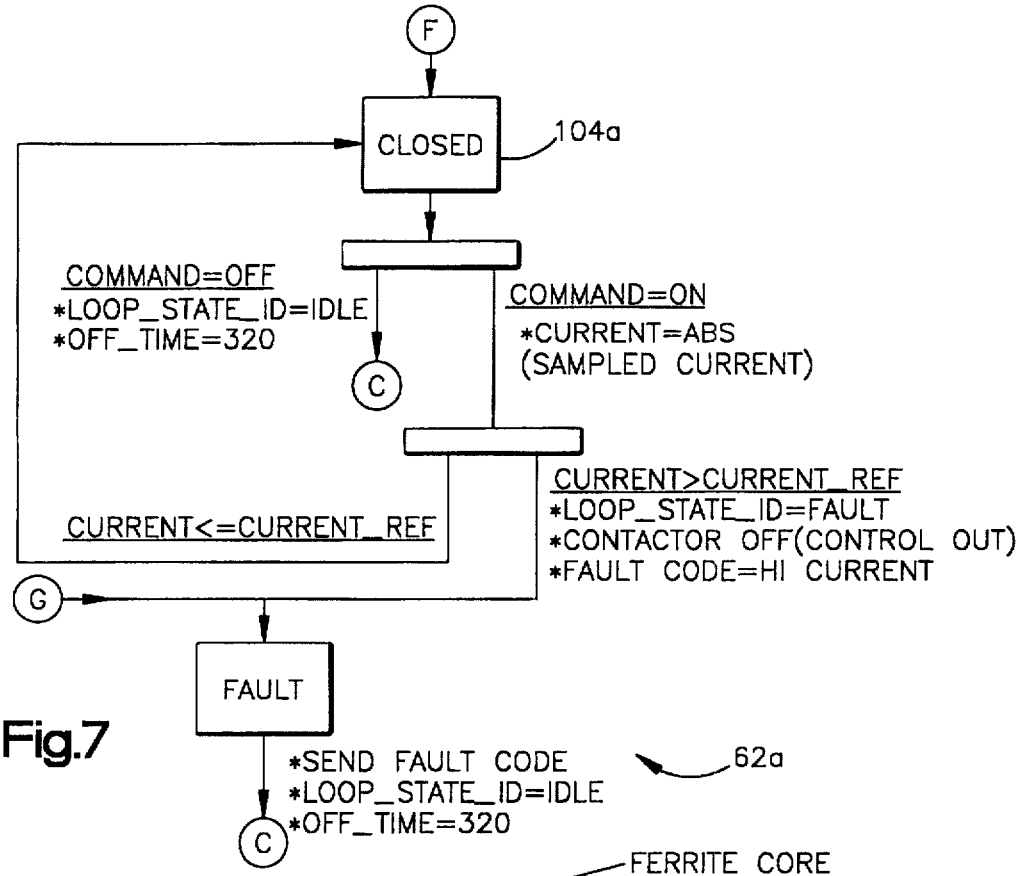

When the start count reaches 160, the state of the algorithm 62a changes from the start state 66a to the pull-in state 82a (FIG. 5). Once in the pull-in state 82a, the pull-in count is checked against an upper limit, for example, 320. If the upper limit of the time count has not been exceeded, the algorithm remains in the pull-in state 82a.

If the pull-in time limit, which is then assumed to be 320, has been exceeded, variables are initialized and the command signal is checked again. If the command signal has been changed to an OFF command, the algorithm 62a changes back to the idle state 64a. If an ON command is still present, the seal check state 86a (FIG. 5) is entered. Contemporaneously therewith, a seal count is incremented, as is indicated at 88a in FIG. 5. A reference current which is twenty percent of the maximum initial current, is calculated in the manner indicated at 92a in FIG. 5. The coil current is measured by the current sensor 34 and the absolute magnitude transmitted to the controller 30 as indicated at 90a in FIG. 5.

The coil current is repetitively checked to determine a maximum value for the holding or seal current. Next, the seal count is checked to see if it has reached 160 counts or 16 milliseconds. If the seal count has not reached 160, the algorithm 62a remains in the seal check state. If the count of 160 has been reached, the maximum seal current is checked against the previously calculated reference current, that is, against twenty percent of the maximum magnitude of the initial current conducted to the coil 16. This step is indicated at 98a in FIG. 6.

If the seal current is less than or equal to the reference current, that is, less than or equal to twenty percent of the maximum initial current, a sealed or contactor closed condition is indicated. When this occurs, the algorithm 62a enters the closed state 104a (FIG. 7), provided the command is still ON. If the command is not still ON, the algorithm returns to the idle state.

If, on the other hand, the seal current is greater than the reference current, that is, greater than twenty percent of the maximum initial current, the contactor 12 has failed to seal and a fault state is entered. The contactor 12 is also turned off at this time. Any time the fault state is entered, a malfunction signal is provided, the contactor is commanded off, and the algorithm 62a returns to the idle state.

Once the algorithm has entered the closed condition, the command is checked. If the contactor 12 has been commanded to the unactuated condition, the idle state is entered. If the contactor is still commanded to the actuated condition, the magnitude of the seal or holding current is checked. If the seal or holding current remains less than or equal to the reference current, that is, twenty percent of the maximum initial current, the algorithm 62a remains in the closed state. If the reference current has been exceeded, the contactor is turned off, a high current fault is indicated and the fault state is entered. At the same time, a malfunction signal is provided.

Contact Position Sensing

In the embodiment of the invention illustrated in FIGS. 1–7, the coil current is monitored to determine the condition of the contactor 12. In the embodiment of the invention illustrated in FIGS. 8 and 9, the actual position of the movable contacts connected with the armature of the contactor is monitored. Since the embodiment of the invention illustrated in FIGS. 8 and 9 is generally similar to the embodiment of the invention illustrated in FIGS. 1–7, similar numerals will be utilized to designate similar components, the suffix letter "b" being associated with the numerals of FIGS. 8 and 9 in order to avoid confusion.

A contactor 12b (FIG. 8) is connected with control circuitry 14b. The contactor 12b has a coil 16b which extends around a frame 48b. Upon energization of the coil 16b, an armature 50b is attracted toward the frame 48b. Thus, the armature 50b is moved downward (as viewed in FIG. 8). As the armature 50b moves downward toward the frame 48b, movable contacts 20b and 22b move into engagement with fixed contacts 24b and 26b.

A controller 30b is operable to actuate a switch 32b to control energization of the coil 16b. Thus, when the contactor is commanded to the unactuated condition illustrated in FIG. 8, the controller 30b maintains the switch 32b in an open condition and the contactor 12b remains in an open condition. Upon receiving a command to effect operation of the contactor 12b from the unactuated condition to the actuated condition, the controller 30b effects operation of the switch 32b to a closed condition to energize the coil 16b with electrical energy conducted over a lead 70b. The switch 32b may be either a mechanical switch or a semiconductor.

Figure 8:
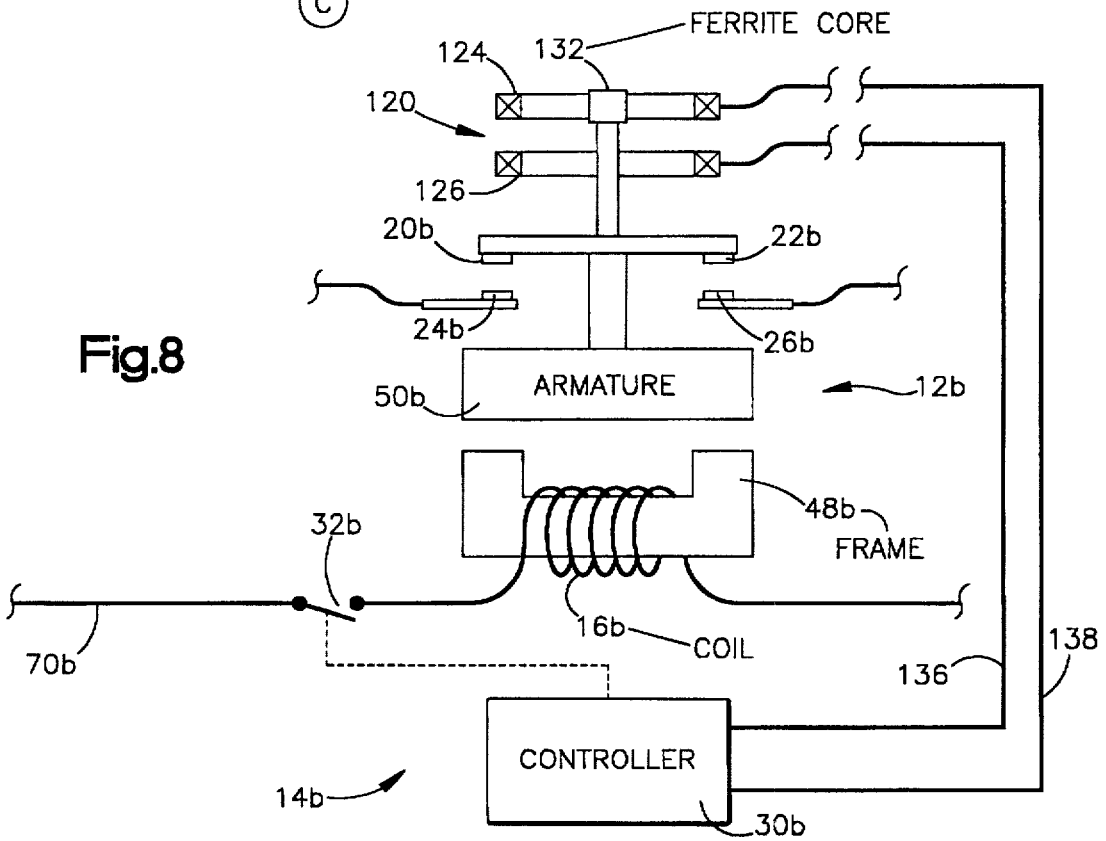
FIG. 8 is a schematic illustration of a second embodiment of the contactor control system and FIG. 9 is a simplified schematic illustration of an algorithm which is utilized to determine whether or not the contactor of FIG. 8 has properly operated from an unactuated condition to an actuated condition.
Figure 9:
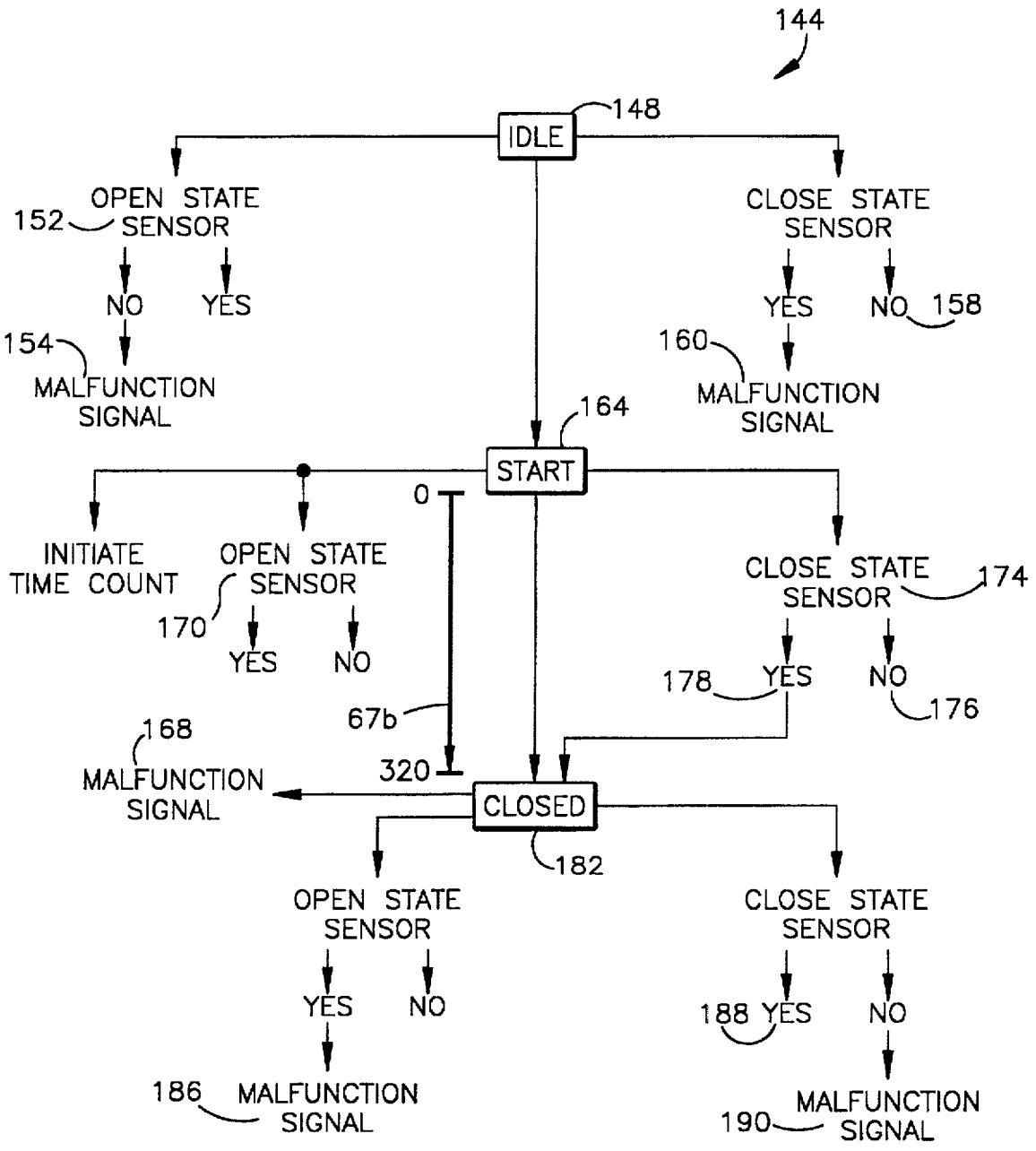

In accordance with a feature of the embodiment of the invention illustrated in FIG. 8, a sensor assembly 120 is provided to sense the position of the movable contacts 20b and 22b. The sensor assembly 120 includes a first or open condition coil 124 and a second or closed condition coil 126. The annular coils 124 and 126 are axially aligned with each other and are spaced axially apart by a distance which is equal to the distance between the movable contacts 20b and 22b and the fixed contacts 24b and 26b when the contactor 12b is in the actuated condition of FIG. 8.

In one specific embodiment of the invention, the coils 124 and 126 used coil bobbin having an outside diameter of approximately 0.285 inches, an inside diameter of approximately 0.160 inches, and a height or axial extent of approximately 0.14 inches. In this specific embodiment of the invention, the coils 124 and 126 each had approximately 240 turns of number 38 wire to produce approximately 250 microhenries inductance with no core.

A small ferrite core 132 is connected with the movable contacts 20b and 22b. The specific embodiment of the core 132 used with coils 124 and 126 having the dimensions set forth above, had cylindrical configuration with a diameter of approximately 0.140 inches and an axial extent of approximately 0.125 inches. It is contemplated that the coils 124 and 126 and core 132 may have dimensions other than the specific dimensions set forth above.

When the contactor 12b is in the open condition illustrated schematically in FIG. 8 and the core 32 is positioned within the coil 124, the coil has an inductance of approximately 450 microhenries. When the contactor 12b is operated to the closed condition, the ferrite core 132 is disposed in the coil 126. At this time, the coil 126 will have an inductance of approximately 450 microhenries and the coil 124 would have an inductance of approximately 250 microhenries. Signals corresponding to the inductance of the coils 124 and 126 are transmitted to the controller 30b over leads indicated schematically at 136 and 138 in FIG. 8.

It should be understood that the foregoing specific dimensions and electrical characteristics for the coils 124 and 126 and core 132 have been set forth herein for purposes of clarity of description and not for purposes of limiting the invention. It should be understood that coils and cores having different dimensions and electrical characteristics could be utilized if desired.

In the illustrated embodiment of the invention, the sensor 120 senses the position of the movable contacts 20b and 22b as a function of the change in inductance of the coils 124 and 126. It is contemplated that the sensor assembly 120 could have a different construction if desired. For example, a Hall effect sensor assembly of the type disclosed in U.S. Pat. No. 5,424,900 could be utilized. Alternatively, an optical sensor assembly could be utilized to detect the position of the movable contacts 20b and 22b.

An algorithm 144 schematically illustrates the manner in which the controller 30b cooperates with the contactor 12b (FIG. 9). The algorithm 144 is initially in an idle state indicated at 148 in FIG. 9. At this time, the contactor 12b is in the open or unactuated condition illustrated in FIG. 8 and switch 32b is open so that the coil 16b is de-energized.

The controller 30b periodically checks the sensor assembly 120 to be certain that the contactor 12b is in the desired unactuated condition. Thus, the inductance of the open condition coil is checked, as indicated schematically at 152 in FIG. 9. If the contactor is in the unactuated condition illustrated in FIG. 8, the inductance of the open condition coil 124 will be relatively high and an affirmative or yes signal will be provided indicating that the conductor is in the desired unactuated condition. However, if for some reason the contactor 12b has malfunctioned and the movable contacts 20b and 22b are not in the illustrated open position, the ferrite core 132 will be displaced relative to the open condition coil 124. This will result in the production of a malfunction signal, indicated at 154 in FIG. 9, by the controller 32b.

In addition, the inductance of the closed condition coil 126 is checked. If the contactor 12b is in the unactuated condition illustrated in FIG. 8, the ferrite core 132 will be spaced from the closed condition coil 126 and the controller 30b will detect the relatively small inductance of the closed condition coil 126 in the manner indicated schematically at 158 in FIG. 9. However, if there has been a malfunction of the contactor 12b and the ferrite core 132 is disposed within the closed condition coil 126, the relatively high inductance of the closed condition coil will be detected by the controller 30b and a malfunction signal provided, in the manner indicated at 160 in FIG. 9.

When the contactor 12b is commanded from the unactuated condition illustrated in FIG. 8 to the closed or actuated condition, the state of the algorithm 144 will change from the idle state 148 to the start state 164. As the state of the algorithm 144 changes from the idle state 148 to the start state 164, the switch 32b is closed. As the switch 32b is closed, a start state time count 67b begins at zero. If the contactor 12b does not close within a predetermined length of time, a malfunction signal is provided by the controller 30b. Thus, if the start state time count reaches a predetermined value, for example, 320 corresponding to 32 milliseconds, without the contactor operating to the actuated condition, a malfunction signal is provided in the manner indicated at 168 in FIG. 9.

When the algorithm 144 is in the start state 164, the sensor assembly 120 is repeatedly checked to determine the condition of the contactor 12b. Thus, the open condition coil 124 is checked in the manner indicated schematically at 170 in FIG. 9. If the ferrite core 132 is disposed in the open condition coil 124 so that the coil has a relatively high inductance, a yes or affirmative signal indicates that the contactor 12b is in the unactuated condition illustrated in FIG. 8. However, if the ferrite core has moved out of the open condition coil 124, by movement of the contacts 20b and 22b toward the fixed contacts 24b and 26b, the relatively low inductance of the open condition coil 124 is detected by the controller 30b with a resulting no or negative input.

The closed condition coil 126 is then checked, in the manner indicated schematically at 174 in FIG. 9. If the open condition coil 124 has a relatively low inductance indicating that the ferrite core 132 has moved out of the coil and if the closed condition coil 126 has a relatively low inductance indicating that the ferrite core has not moved into the closed condition coil, the relatively low inductance of the closed condition coil will be detected by the controller 30b in the manner indicated schematically at 176 in FIG. 9. At this time, both the open condition coil 124 and the closed condition coil 126 have a relatively low inductance. This means that the ferrite core 132 has moved to a location part way between the two coils. The movable contacts 20b and 22b will have moved to a position part way between the open position illustrated in FIG. 8 and a closed condition in which they are in engagement with the fixed contacts 24b and 26b.

Upon operation of the contact 12b to the actuated condition, the movable contacts 20b and 22b move into engagement with the fixed contacts 24b and 26b. At the same time, the ferrite core 132 moves into the closed condition coil 126. When this occurs, the controller 30b detects the increase in the inductance of the closed condition coil 126 and provides an affirmative signal, indicated at 178 in FIG. 9. When this occurs, the state of the algorithm 144 changes from the start state to the closed state.

As was previously explained, the state of the algorithm 144 must change from the start state indicated at 164 to the closed state indicated at 182 before the predetermined time count of 320 is achieved. If the algorithm 144 has not changed from the start state 164 to the closed state 182 within a time count of 320, a malfunction signal 168 is provided. When this occurs, the algorithm 144 reverts to the idle state 148.

Once the contactor 12b has operated to the actuated condition and the algorithm 144 has changed to the closed state, the sensor assembly 120 is repetitively checked to be certain that the contactor 12b remains in the desired actuated condition with the movable contacts 20b and 22b in engagement with the fixed contacts 24b and 26b. Thus, the open condition coil 124 is checked. If the contactor 12b is in the desired actuated condition, the ferrite core 132 will be spaced from the open condition coil 124 and a negative signal will be provided by the controller 30b. However, if for some unforeseen reason the ferrite core 132 is disposed within the open condition core 124, the resulting relatively high inductance of the open condition coil 124 will be detected by the controller 30b and a malfunction signal, indicated at 186 in FIG. 9, is provided.

Similarly, the closed condition coil 126 is checked by the controller 30b. If the contactor 12b is in the desired actuated condition, the ferrite core 132 will be disposed within the closed condition coil 126. The resulting relatively high inductance of the closed condition coil 126 will be detected by the controller 30b and an affirmative signal, indicated at 188 in FIG. 9, will be provided by the controller 30b. However, if a malfunction of the contactor 12b has occurred, the ferrite core 132 will be offset from the closed condition coil 126. The resulting relatively low inductance of the closed condition coil 126 will be detected by the controller 30b and a malfunction signal provided.

The contactor 12b will remain in the actuated condition until it is commanded to return to the unactuated condition. Upon being commanded to return to the unactuated condition, the state of the algorithm 144 will change from the closed state 182 back to the idle state 148. As this occurs, the controller 30b will effect operation of the switch 32b from the closed condition to the open condition. As the switch 32b is opened, the coil 16b is de-energized and the movable contacts 20b and 22b will move upward (as viewed in FIG. 8) out of engagement with the fixed contacts 24b and 26b.

After sufficient time has elapsed for the contactor 12b to operate from the actuated condition to the unactuated condition, the controller 30b will check the sensor assembly 120 to determine whether or not the open condition coil 124 has a relatively high inductance and the closed condition coil 126 has a relatively low inductance corresponding to an unactuated condition of the contactor. Of course, if the contactor 12b does not return to the unactuated condition as commanded, a malfunction signal will be provided in the manner indicated either at 154 or 160 in the algorithm 144.

Conclusion

The present invention provides a new and improved method for controlling the operation of a contactor 12. Upon initiation of operation of the contactor 12 from an unactuated condition to an actuated condition, the maximum magnitude 44 of an initial current 44 conducted to the coil 16 of the contactor is determined (78). After a period of time sufficient for the contactor 12 to actuate, the magnitude of a holding current 54 conducted to the coil 16 is determined (94). A determination is made as to whether or not the holding current 54 exceeds a predetermined function of the maximum magnitude 44 of the initial current 42 conducted to the coil 16 of the contactor 12. If the holding current 54 is less than the predetermined function of the initial current 42, the contactor 12 has been properly actuated to the closed condition.

In another embodiment of the invention (FIGS. 8 and 9), a sensor assembly 120 is provided to detect the position of the movable contacts 20b and 22b of the contactor 12b relative to stationary contacts. In both embodiments of the invention, a determination is made as to whether or not the contactor is properly operated from the unactuated condition to the actuated condition at the end of a predetermined time period.

Having described the invention, the following is claimed:

1. A method of monitoring operation of a contactor, said method comprising the steps of initiating operation of the contactor from the unactuated condition to the actuated condition by initiating a flow of current to a coil of the contactor, determining the magnitude of an initial current conducted to the coil of the contactor, determining the magnitude of a reference current which is a predetermined function of the magnitude of the initial current conducted to the coil of the contactor, determining the magnitude of an operating current conducted to the coil of the contactor after sufficient time has elapsed after initiating operation of the contactor for the contactor to have operated from the unactuated condition to the actuated condition, and determining whether or not the contactor has operated from the unactuated condition to the actuated condition by determining whether the operating current conducted to the coil of the contactor exceeds the reference current.

2. A method as set forth in claim 1 wherein said step of initiating a flow of current to the coil of the contactor includes allowing the magnitude of the initial current which is conducted to the coil to increase to a maximum initial current, said step of determining the magnitude of the initial current conducted to the coil of the contactor includes sensing the initial current conducted to the coil to detect a maximum magnitude of initial current conducted to the coil, said step of determining the magnitude of a reference current includes determining the magnitude of a reference current which is the predetermined function of the detected maximum magnitude of the initial current conducted to the coil.

3. A method as set forth in claim 1 further including the step of detecting the occurrence of a malfunctioning of the contactor while the contactor is in the actuated condition by repeatedly determining whether the operating current exceeds the reference current while the contactor remains in the actuated condition.

4. A method as set forth in claim 1 further including the step of providing a signal indicative of a contactor malfunction in the event said step of determining whether the operating current conducted to the coil of the contactor exceeds the reference current results in a determination that the operating current conducted to the coil of the contactor is greater than the reference current.

5. A method as set forth in claim 1 further including the steps of initiating a time count upon performance of said step of initiating operation of the contactor from the unactuated condition to the actuated condition, checking the time count to determine when a predetermined length of time has elapsed, and performing said step of determining whether or not the contactor has operated from the unactuated condition to the actuated condition when the predetermined length of time has elapsed.

6. A method of monitoring operation of a contactor, said method comprising the steps of initiating operation of a contactor from an unactuated condition to an actuated condition, determining a maximum magnitude of current conducted to a coil of the contactor during a first predetermined time period after initiating operation of the contactor from the unactuated condition to the actuated condition, determining a reference current which is a function of the maximum magnitude of the current conducted to the coil of the contactor during the first predetermined time period, determining if the magnitude of the current conducted to the coil of the contactor exceeds the reference current at the end of a second predetermined time period after initiating operation of the contactor from the unactuated condition to the actuated condition, and providing a signal indicative of a failure of the contactor to operate from the unactuated condition to the actuated condition if at the end of the second predetermined time period the current conducted to the coil of the contactor is greater than the reference current.

7. A method as set forth in claim 6 wherein said step of determining a maximum magnitude for current conducted to the coil of the contactor during the first predetermined time period after initiating operation of the contactor from the unactuated condition to an actuated condition includes measuring the current conducted to the coil of the contactor during the first predetermined time period.

8. A method as set forth in claim 6 wherein said step of determining if the magnitude of the current conducted to the coil of the contactor exceeds the reference current at the end of the second predetermined time period after initiating operation of the contactor from the unactuated condition to the actuated condition includes measuring the current conducted to the coil of the contactor after the second predetermined time period has elapsed.

9. A method as set forth in claim 6 including the step of repeatedly determining if the magnitude of the current conducted to the coil of the contactor exceeds or is less than the reference current over a third period of time after the second predetermined time period has elapsed, and providing a signal indicative of a contactor malfunction if the current conducted to the coil of the contactor is greater than the reference current during the third period of time.

10. A method as set forth in claim 6 wherein the contactor includes a movable member which is in a first position when the contactor is in the unactuated condition and is in a second position when the contactor is in the actuated condition, said method further including the step of determining whether or not the contactor is in the unactuated condition by sensing whether or not the movable member is in the first position.

11. A method as set forth in claim 6 wherein the contactor includes a movable member which is in a first position when the contactor is in the unactuated condition and is in a second position when the contactor is in the actuated condition, said method further including the step of determining whether or not the contactor is in the actuated condition by sensing whether or not the movable member is in the second position.

12. A method of monitoring operation of a contactor, said method comprising the steps of providing an input signal, initiating operation of the contactor from the unactuated condition to the actuated condition in response to the input signal, initiating a time count in response to the input signal, determining whether or not the contactor is in the unactuated condition prior to performance of said step of initiating the time count, providing a signal indicative of a contactor malfunction in response to a determination that the contactor is not in the unactuated condition prior to performance of said step of initiating the time count, checking the time count to determine when a predetermined length of time has elapsed, and determining whether or not the contactor has operated from the unactuated condition to the actuated condition at the end of the predetermined length of time.

13. A method as set forth in claim 12 further including the step of repeatedly determining whether or not the contactor is in the actuated condition after the predetermined length of time has elapsed and after having performed said step of determining whether or not the contactor has operated from the unactuated condition to the actuated condition at the end of the predetermined length of time.

14. A method as set forth in claim 13 wherein said step of repeatedly determining whether or not the contactor is in the actuated condition after the predetermined length of time has elapsed includes determining whether or not the contactor is in the actuated condition each time a predetermined length of time elapses after actuation of the contactor to the actuated condition.

15. A method as set forth in claim 12 wherein said step of determining whether or not the contactor has operated from the unactuated condition to the actuated condition includes determining whether or not a current which exceeds a predetermined magnitude is being conducted to a coil of the contactor.

16. A method as set forth in claim 12 wherein the contactor includes a movable member which is in a first position when the contactor is in the unactuated condition and is in a second position when the contactor is in the actuated condition, said step of determining whether or not the contactor has operated from the unactuated condition to the actuated condition at the end of the predetermined length of time includes sensing whether or not the movable member is in the second position.

17. A method as set forth in claim 12 wherein the contactor includes a movable member which is in a first position when the contactor is in the unactuated condition and is in a second position when the contactor is in the actuated condition, step of determining whether or not the contactor is in the unactuated condition includes sensing whether or not the movable member is in the first position.

18. A method as set forth in claim 12 wherein the contactor includes a movable member which is in a first position when the contactor is in the unactuated condition and is in a second position when the contactor is in the actuated condition, said method further including the step of determining whether or not the contactor is in the actuated condition by sensing whether or not the movable member is in the second position.

19. A method of monitoring operation of a contactor, said method comprising the steps of providing an input signal, initiating operation of the contactor from the unactuated condition to the actuated condition in response to the input signal, determining whether or not the contactor is in the unactuated condition prior to performance of said step of initiating operation of the contactor from the unactuated condition to the actuated condition, providing a contactor malfunction signal in response to a determination that the contactor is in a condition other than the unactuated condition prior to performance of said step of initiating operation of the contactor from the unactuated condition to the actuated condition, initiating a time count in response to the input signal, checking the time count to determine when a predetermined length of time has elapsed, and determining whether or not the contactor has operated from the unactuated condition to the actuated condition at the end of the predetermined length of time.

20. A method as set forth in claim 19 wherein said step of determining whether or not the contactor is in the unactuated condition is performed prior to performance of said step of initiating the time count, said step of providing a signal indicative of a contactor malfunction in response to a determination that the contactor is not in the unactuated condition is performed prior to performance of said step of initiating the time count.

21. A method as set forth in claim 19 further including the step of repeatedly determining whether or not the contactor is in the actuated condition after the predetermined length of time has elapsed and after having performed said step of determining whether or not the contactor has operated from the unactuated condition to the actuated condition at the end of the predetermined length of time.

22. A method as set forth in claim 21 wherein said step of repeatedly determining whether or not the contactor is in the actuated condition after the predetermined length of time has elapsed includes determining whether or not the contactor is in the actuated condition each time a predetermined length of time elapses after actuation of the contactor to the actuated condition.

23. A method as set forth in claim 19 wherein said step of determining whether or not the contactor has operated from the unactuated condition to the actuated condition includes determining whether or not a current which exceeds a predetermined magnitude is being conducted to a coil of the contactor.

24. A method as set forth in claim 19 wherein the contactor includes a movable member which is in a first position when the contactor is in the unactuated condition and is in a second position when the contactor is in the actuated condition, said step of determining whether or not the contactor has operated from the unactuated condition to the actuated condition at the end of the predetermined length of time includes sensing whether or not the movable member is in the second position.

25. A method as set forth in claim 19 wherein the contactor includes a movable member which is in a first position when the contactor is in the unactuated condition and is in a second position when the contactor is in the actuated condition, said step of determining whether or not the contactor is in the unactuated condition includes sensing whether or not the movable member is in the first position.

26. A method as set forth in claim 19 wherein the contactor includes a movable member which is in a first position when the contactor is in the unactuated condition and is in a second position when the contactor is in the actuated condition, said method further including the step of determining whether or not the contactor is in the actuated condition by sensing whether or not the movable member is in the second position.

27. A method as set forth in claim 19 wherein the contactor includes a movable member which is in a first position when the contactor is in the unactuated condition and a second position when the contactor is in the actuated condition, said step of determining whether or not the contactor is in the unactuated condition includes sensing whether or not the movable member is in the first position prior to initiation of said step of initiating operation of the contactor from the unactuated condition to an actuated condition, said step of providing a signal indicative of a contactor malfunction being performed in response to sensing that the movable member is not in the first position prior to initiating operation of the contactor from the unactuated condition to the actuated condition.

28. A method of monitoring operation of a contactor having a movable member which is in a first position when the contactor is in an unactuated condition and a second position when the contactor is in an actuated condition, said method comprising the steps of providing an input signal, initiating operation of the contactor from the unactuated condition to the actuated condition in response to the input signal, determining whether or not the contactor is in the unactuated condition by sensing whether or not the movable member is in the first position prior to initiation of said step of initiating operation of the contactor from the unactuated condition to an actuated condition, providing a signal indicative of a contactor malfunction in response to sensing that the movable member is not in the first position prior to initiating operation of the contactor from the unactuated condition to the actuated condition, initiating a time count in response to the input signal, checking the time count to determine when a predetermined length of time has elapsed, and determining whether or not the contactor has operated from the unactuated condition to the actuated condition at the end of the predetermined length of time.

29. A method as set forth in claim 28 wherein said step of determining whether or not the contactor is in the unactuated condition is performed prior to performance of said step of initiating the time count, said step of providing a signal indicative of a contactor malfunction in response to a determination that the contactor is not in the unactuated condition is performed prior to performance of said step of initiating the time count.

30. A method as set forth in claim 28 further including the step of repeatedly determining whether or not the contactor is in the actuated condition after the predetermined length of time has elapsed and after having performed said step of determining whether or not the contactor has operated from the unactuated condition to the actuated condition at the end of the predetermined length of time.

31. A method as set forth in claim 30 wherein said step of repeatedly determining whether or not the contactor is in the actuated condition after the predetermined length of time has elapsed includes determining whether or not the contactor is in the actuated condition each time a predetermined length of time elapses after actuation of the contactor to the actuated condition.

32. A method as set forth in claim 28 wherein said step of determining whether or not the contactor has operated from the unactuated condition to the actuated condition includes determining whether or not a current which exceeds a predetermined magnitude is being conducted to a coil of the contactor.

33. A method as set forth in claim 28 wherein said step of determining whether or not the contactor has operated from the unactuated condition to the actuated condition at the end of the predetermined length of time includes sensing whether or not the movable member is in the second position.

34. A method of monitoring operation of a contactor, said method comprising the steps of initiating operation of a contactor from an unactuated condition to an actuated condition, determining whether or not the contactor is in the unactuated condition prior to performance of said step of initiating operation of the contactor from the unactuated condition to the actuated condition, providing a contactor malfunction signal in response to a determination that the contactor is in a condition other than the unactuated condition prior to performance of said step of initiating operation of the contactor from the unactuated condition to the actuated condition, determining a maximum magnitude of current conducted to a coil of the contactor during a first predetermined time period after initiating operation of the contactor from the unactuated condition to the actuated condition, determining a reference current which is a function of the maximum magnitude of the current conducted to the coil of the contactor during the first predetermined time period, determining if the magnitude of the current conducted to the coil of the contactor exceeds the reference current at the end of a second predetermined time period after initiating operation of the contactor from the unactuated condition to the actuated condition, and providing a signal indicative of a failure of the contactor to operate from the unactuated condition to the actuated condition if at the end of the second predetermined time period the current conducted to the coil of the contactor is greater than the reference current.

35. A method as set forth in claim 34 wherein said step of determining a maximum magnitude for current conducted to the coil of the contactor during the first predetermined time period after initiating operation of the contactor from the unactuated condition to an actuated condition includes measuring the current conducted to the coil of the contactor during the first predetermined time period.

36. A method as set forth in claim 35 wherein said step of determining if the magnitude of the current conducted to the coil of the contactor exceeds the reference current at the end of the second predetermined time period after initiating operation of the contactor from the unactuated condition to the actuated condition includes measuring the current conducted to the coil of the contactor after the second predetermined time period has elapsed.

37. A method as set forth in claim 35 further including the step of repeatedly determining if the magnitude of the current conducted to the coil of the contactor exceeds or is less than the reference current over a third period of time after the second predetermined time period has elapsed, and providing a signal indicative of a contactor malfunction if the current conducted to the coil of the contactor is greater than the reference current during the third period of time.

38. A method as set forth in claim 34 wherein the contactor includes a movable member which is in a first position when the contactor is in the unactuated condition and is in a second position when the contactor is in the actuated condition, said step of determining whether or not the contactor is in the unactuated condition includes sensing whether or not the movable member is in the first position.

39. A method as set forth in claim 34 wherein the contactor includes a movable member which is in a first position when the contactor is in the unactuated condition and is in a second position when the contactor is in the actuated condition, said method further including the step of determining whether or not the contactor is in the actuated condition by sensing whether or not the movable member is in the second position.

40. A method of monitoring operation of a contactor having a movable member which is in a first position when the contactor is in the unactuated condition and is in a second position when the contactor is in the actuated condition, said method comprising the steps of initiating operation of a contactor from an unactuated condition to an actuated condition, determining whether or not the contactor is in the unactuated condition by sensing whether or not the movable member is in the first position prior to initiation of said step of initiating operation of the contactor from the unactuated condition to an actuated condition, providing a signal indicative of a contactor malfunction in response to sensing that the movable member is not in the first position prior to initiating operation of the contactor from the unactuated condition to the actuated condition, determining a maximum magnitude of current conducted to a coil of the contactor during a first predetermined time period after initiating operation of the contactor from the unactuated condition to the actuated condition, determining a reference current which is a function of the maximum magnitude of the current conducted to the coil of the contactor during the first predetermined time period, determining if the magnitude of the current conducted to the coil of the contactor exceeds the reference current at the end of a second predetermined time period after initiating operation of the contactor from the unactuated condition to the actuated condition, and providing a signal indicative of a failure of the contactor to operate from the unactuated condition to the actuated condition if at the end of the second predetermined time period the current conducted to the coil of the contactor is greater than the reference current.

41. A method as set forth in claim 40 wherein said step of determining a maximum magnitude for current conducted to the coil of the contactor during the first predetermined time period after initiating operation of the contactor from the unactuated condition to an actuated condition includes measuring the current conducted to the coil of the contactor during the first predetermined time period.

42. A method as set forth in claim 40 wherein said step of determining if the magnitude of the current conducted to the coil of the contactor exceeds the reference current at the end of the second predetermined time period after initiating operation of the contactor from the unactuated condition to the actuated condition includes measuring the current conducted to the coil of the contactor after the second predetermined time period has elapsed.

43. A method as set forth in claim 40 further including the step of repeatedly determining if the magnitude of the current conducted to the coil of the contactor exceeds or is less than the reference current over a third period of time after the second predetermined time period has elapsed, and providing a signal indicative of a contactor malfunction if the current conducted to the coil of the contactor is greater than the reference current during the third period of time.

* * * * *